US007056240B2

(12) United States Patent
Brock et al.

(10) Patent No.: US 7,056,240 B2
(45) Date of Patent: Jun. 6, 2006

(54) TRAINING BAT HAVING MOVEABLE INTERNAL WEIGHT AND METHOD

(76) Inventors: Michael Brock, 292 Davis Hill Ct., Henderson, NV (US) 89074; Zdravka Smircic, 292 Davis Hill Ct., Henderson, NV (US) 89074

( * ) Notice: Subject to any disclaimer, the term of this patent is extended or adjusted under 35 U.S.C. 154(b) by 0 days.

(21) Appl. No.: 10/842,274

(22) Filed: May 10, 2004

(65) Prior Publication Data

US 2004/0248675 A1 Dec. 9, 2004

Related U.S. Application Data

(60) Provisional application No. 60/469,882, filed on May 13, 2003.

(51) Int. Cl.
*A63B 69/00* (2006.01)

(52) U.S. Cl. ..... 473/457; 473/422

(58) Field of Classification Search ..... 473/457, 473/451, 422, 564–567; 482/109
See application file for complete search history.

(56) References Cited

U.S. PATENT DOCUMENTS

| | | | | | |
|---|---|---|---|---|---|
| 64,081 | A * | 4/1867 | Dibble | 482/109 |
| 3,136,546 | A * | 6/1964 | Connolly | 473/234 |
| 3,414,260 | A * | 12/1968 | Gust | 482/109 |
| 4,819,935 | A * | 4/1989 | Dirksing et al. | 482/109 |
| 4,898,386 | A * | 2/1990 | Anderson | 473/457 |
| 5,277,421 | A * | 1/1994 | Rewolinski | 473/457 |
| 5,334,118 | A * | 8/1994 | Dantolan | 482/93 |
| 6,569,042 | B1 * | 5/2003 | LaChance et al. | 473/457 |
| 6,692,386 | B1 * | 2/2004 | Brundage | 473/457 |

* cited by examiner

*Primary Examiner*—Eugene Kim
*Assistant Examiner*—M. Chambers
(74) *Attorney, Agent, or Firm*—Weiss & Moy P.C.

(57) ABSTRACT

A training bat has a knob, handle section and barrel section. A weight is located within the interior of the barrel section on a rotatable shaft, and is moveable linearly. Linear movement of the weight is caused by rotation of the shaft. Preferably, the shaft is coupled to the knob, so that rotation of the knob causes rotation of the shaft and linear movement of the weight along at least a portion of the barrel section.

5 Claims, 2 Drawing Sheets

TRAINING BAT HAVING MOVEABLE INTERNAL WEIGHT AND METHOD

RELATED APPLICATION

This non-provisional application claims priority to provisional application No. 60/469,882, filed May 13, 2003.

FIELD OF THE INVENTION

This invention relates generally to bat sports such as baseball and softball and, more particularly, to a training bat having an internal weight, the position of which may be linearly adjusted by the user.

BACKGROUND OF THE INVENTION

The use of weighted baseball bats for training purposes is known. The idea has been to provide a heavier bat than a user would typically handle. This was intended to contribute to the building of the batter's hitting muscles, and also to give the batter the feeling that the un-weighted bat is easier to swing.

Classically, the weighting of a baseball bat was accomplished by the use of a donut-shaped weight, which was slid onto a bat from the handle end, and which would move down the length of the bat until the interior of the donut frictionally engaged the bat surface. When in position, the user could swing the bat which, by virtue of the placement of the donut thereon, would have a heavier weight.

There are several limitations inherent in the use of donuts. First, the position of the donut along the bat is not readily adjustable. Because the interior diameter of the donut and the exterior diameter of the bat are fixed, the placement of a particular donut on a particular bat will always result in the donut being positioned in substantially the same spot along the length of the bat. If a user wishes to move the donut to a position that is more proximate or distal the handle, this may not readily be accomplished.

In addition, the presence of the donut on the bat makes it unsuitable for use in a batting situation. While a player can take practice swings with a bat that has been weighted with a donut, he or she may not actually attempt to hit a ball with such a bat/donut combination, since the presence of the donut could interfere with the otherwise normal response of a ball to being struck by a bat.

It is believed that there has previously been provided a hollow wood bat with an internal weight, wherein the distribution of the weight within the bat could be adjusted from a position that was remote from the bat handle. However, these bats were prone to breaking, and the adjustment mechanism was not convenient to the user.

A need therefore existed for a training bat having an internal weight, wherein the position of the weight along the length of the bat is adjustable by the user. The bat should be sufficiently strong to be useable in actual hitting situations without breaking, and adjustment of weight position should be relatively convenient to the user. The present invention satisfies these needs and provides other, related, advantages.

SUMMARY OF THE INVENTION

In accordance with one embodiment of the present invention, a training bat is disclosed. The training bat comprises, in combination: a bat having a knob, a handle section, and a barrel section; a rotatable shaft positioned within at least a portion of said barrel section; and a weight positioned along said rotatable shaft; wherein rotation of said rotatable shaft causes linear movement of said weight along at least a portion of said barrel section.

In accordance with another embodiment of the present invention, a training bat is disclosed. The training bat comprises, in combination: a bat having a knob, a handle section, and a barrel section; a rotatable shaft positioned within at least a portion of said barrel section; a weight positioned along said rotatable shaft; and means for rotating said rotatable shaft so as to cause linear movement of said weight along at least a portion of said barrel section.

In accordance with still another embodiment of the present invention, a training method for a sport using a bat to hit a ball is disclosed. The method comprises the steps of: providing a bat having a knob, a handle section, and a barrel section; providing a rotatable shaft positioned within at least a portion of said barrel section; providing a weight positioned along said rotatable shaft; wherein rotation of said rotatable shaft causes linear movement of said weight along at least a portion of said barrel section; rotating said shaft until said weight achieves a desired position within said barrel section; and swinging said bat.

DETAILED DESCRIPTION OF THE PREFERRED EMBODIMENTS

Figure 5:
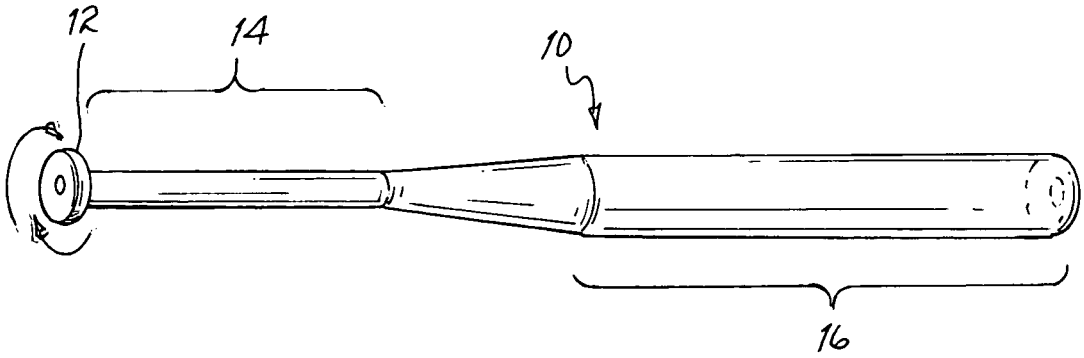
FIG. 5 is a side view of a training bat consistent with an embodiment of the present invention.

Referring first to FIG. 5, a training bat 10 consistent with an embodiment of the present invention is shown. From this view, it can be seen that the exterior of the training bat 10 is like that of a typical prior art bat. Moving from left to right along FIG. 5, the external topography includes a knob (or butt) 12, a handle section 14, and a barrel section 16. The exterior of the bat 10, preferably, is aluminum, or some other high-strength, non-wood material.

Figure 1:
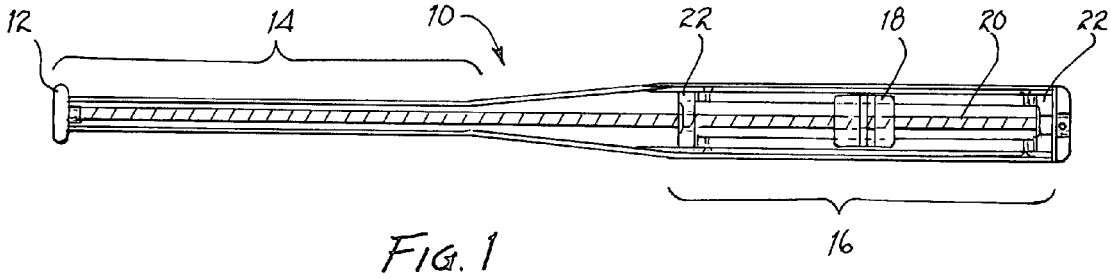
FIG. 1 is a side, cross-sectional view of a training bat consistent with an embodiment of the present invention.
Figure 2:
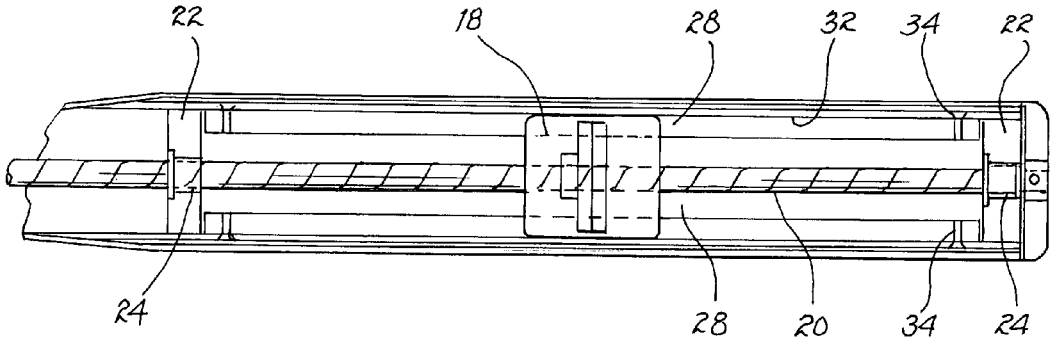
FIG. 2 is a side, cross-sectional view of the head portion of the training bat of FIG. 1.

Turning now to FIGS. 1–2, attention is directed to an embodiment of the training bat 10. It can be seen that a weight 18 is positioned within the barrel section 16. The position of the weight 18 is adjustable along at least a portion of the length of the barrel section 16. The precise location of the weight 18 affects the balance of the bat 10, and different players may have different preferences in this regard.

While the precise manner in which the weight 18 is positioned with an interior of the barrel section 16 and made moveable therein may be varied, a preferred manner of doing so is illustrated in FIGS. 1–2. Preferably, a shaft 20 is positioned within the interior of bat 10, extending in this embodiment from the knob 12 to proximate the opposite end of the bat 10. At least the portion of the shaft 20 upon which the weight 18 is to be permitted to travel should be threaded.

Preferably, two end caps 22 are positioned along the shaft 20 within the barrel section 16. End caps 22 are intended to define the travel boundaries of the weight 18. As shown in detail in FIG. 2, it may be desired to position within end caps 22 bushings 24, which bushings 24 are secured to the shaft 20. While preferred, the end caps 22 may be eliminated.

Figure 3:
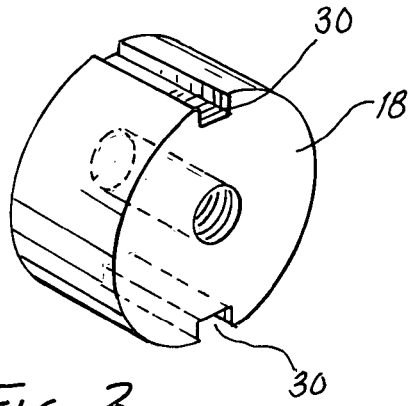
FIG. 3 is a partial side view of a weight useable with a training bat consistent with the present invention.
Figure 4:
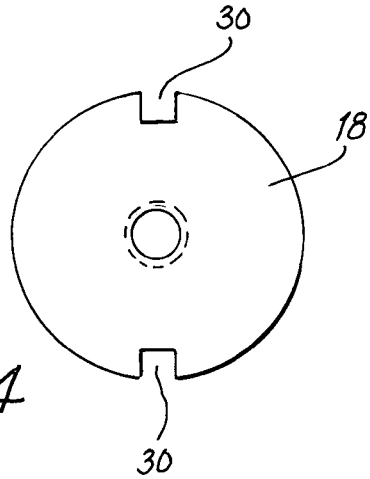
FIG. 4 is an end view of the weight of FIG. 3.

The weight 18 is preferably comprised of metal (though other material may be used), and should have a nut 26 or should be internally threaded (see, e.g., FIG. 3) so that the weight 18 will travel along shaft 20 when shaft 20 is rotated. In this regard, to cause the weight 18 to travel along shaft 20 during the rotation thereof, it is necessary to prevent weight 18 from turning during rotation of shaft 20. This can be accomplished, for example, by providing at least one and preferably two runners 28 within an interior of the barrel section 16. The weight 18, in this embodiment, has notched areas 30 (see, e.g., FIGS. 3–4), which are each dimensioned to engage a runner 28, so that the weight 18 may travel forward and aft along the barrel section 16 on the runners 28, with the combination of the runners 28 and notched areas 30 preventing rotation of the weight 18.

Referring now to FIG. 2, preferably, the barrel section 16 portion of the assembly herein described is positioned within a housing tube 32, which runs substantially the length of the barrel section 16. (See also Picture 1 in the provisional application to which this application claims priority, incorporated herein by reference.) Within the housing tube 32, the end caps 22, runners 28, and weight 18 may be secured. (With respect to the runners 28, these are preferably secured in position through the use of a plurality of screws 34.) The portion of the shaft 20 that is between the end caps 22 will be positioned within the housing tube 32, with the remainder extending in the direction of the knob 12. The housing tube 32, while preferred, is not an essential part of the construction of the bat 10.

Referring now to FIG. 1, it can be seen that the shaft 20 extends from the housing tube 32 to the knob 12. The knob 12 should be rotatably coupled to the handle section 14, so that it may be freely rotated relative thereto by a user. Rotation of the shaft 20 is accomplished by rotation of the knob 12, as indicated in FIG. 5. Rotation of the knob 12 in a first direction causes linear movement of the weight 18 in a first direction. Rotation of the knob 12 in a second, opposite direction causes linear movement of the weight 18 in a second, opposite direction. (Whether a right turn of the knob 12 results in movement of the weight 18 away from or toward the knob 12 depends on the direction of the threading located along shaft 20.)

It should be recognized that the term "baseball" as used herein is intended to include other sports in which a ball is struck by a bat, including for example softball and cricket.

While the invention has been particularly shown and described with reference to preferred embodiments thereof, it will be understood by those skilled in the art that the foregoing and other changes in form and details may be made therein without departing from the spirit and scope of the invention.

For example, as shown herein, it is preferred that rotation of the shaft 20 be accomplished by rotation of the knob 12. It may be desired, alternatively, to have rotation be accomplished by the turning of a rotatable end cap (not shown) positioned at the distal end of the barrel section 16. Still further, it may be desired to have the shaft 20 extend to the end of the barrel section 16 so that it penetrates the end thereof, and to have an Allen-type or other opening therein so that a user having a suitable tool can engage the exposed end of the shaft 20 and turn the shaft 20 in this manner.

Still further, it should be recognized that it may be possible to provide for powered rather than manual rotation of the shaft 20. Provision of a motor within an interior section of the bat 10, to which the shaft 20 would be coupled, would permit the powered rotation of the shaft 20. In such a configuration, it would be necessary to provide an activation member (e.g., a button or switch) on the surface of the bat 10 so that a user could engage the motor. It should be noted that it would be possible to provide a single motor 18 at one end of the shaft 20, or two motors, within one motor located at each end of the shaft 20.

It may also be desired to provide means for a user to be able to determine, other than by feel, the location of the weight 18. For example, a slit along the barrel section 16 (and the housing tube 32, if provided) could permit a user to visually locate the weight 18 along the barrel section 16. Numbered markings along such a slit would provide a user with an ability to not only see the position of the weight 18, but also to record it for future use.

The invention claimed is:

1. A training bat comprising, in combination:
a bat having a knob, a handle section, and a barrel section;
a rotatable shaft positioned within the interior of at least a portion of said barrel section and coupled to a rotatable end of the bat;
a weight positioned along said rotatable shaft; and
at least one runner positioned within said barrel section, wherein said runner is engaged by a notched area on said weight so as to prevent rotation of said weight during rotation of said rotatable shaft;
wherein rotation of said rotatable shaft by rotating the rotatable end of the bat causes linear movement of said weight along at least a portion of said barrel section.

2. The training bat of claim 1 comprising at least two runners.

3. A training bat comprising, in combination,
a bat having a knob, a handle section, and a barrel section;
a rotatable shaft positioned within the interior of at least a portion of said barrel section and coupled to a rotatable end of the bat;
a weight positioned along said rotatable shaft;
a first and second end caps located on said rotatable shaft within said barrel section, with said weight located between said first and second end caps and with said first and second end caps defining the limits of travel of said weight along said rotatable shaft;
a housing tube disposed within said barrel section and in which said first and second end caps are positioned; and
wherein rotation of said rotatable shaft by rotating the rotatable end of the bat causes linear movement of said weight along at least a portion of said barrel section.

4. A training bat comprising, in combination:
a bat having a rotatable knob, a handle section, and a barrel section;
a rotatable shaft positioned within the interior of at least a portion of said barrel section and coupled to the rotatable knob;
a weight positioned along said rotatable shaft; and
at least one runner positioned within said barrel section, wherein said runner is engaged by a notched area on said weight so as to prevent rotation of said weight during rotation of said rotatable shaft;
wherein rotating said rotable knob causes linear movement of said weight along at least a portion of said barrel section.

5. The training bat of claim 4 comprising at least two runners.

* * * * *